US010753704B2

(12) United States Patent
Blake

(10) Patent No.: US 10,753,704 B2
(45) Date of Patent: Aug. 25, 2020

(54) ROTATING BUFFER APPARATUS

(71) Applicant: Jeffrey T. Blake, Milford, CT (US)

(72) Inventor: Jeffrey T. Blake, Milford, CT (US)

( * ) Notice: Subject to any disclaimer, the term of this patent is extended or adjusted under 35 U.S.C. 154(b) by 0 days.

(21) Appl. No.: 16/100,405

(22) Filed: Aug. 10, 2018

(65) Prior Publication Data

US 2019/0056193 A1 Feb. 21, 2019

Related U.S. Application Data

(60) Provisional application No. 62/546,086, filed on Aug. 16, 2017.

(51) Int. Cl.

| | |
|---|---|
| ***F41C 23/14*** | (2006.01) |
| ***F41C 23/08*** | (2006.01) |
| ***F41A 35/06*** | (2006.01) |
| ***F41C 23/20*** | (2006.01) |
| ***F41C 23/04*** | (2006.01) |
| ***F41A 25/12*** | (2006.01) |
| ***F41C 23/06*** | (2006.01) |

(52) U.S. Cl.

CPC ..... *F41C 23/14* (2013.01); *F41A 25/12* (2013.01); *F41A 35/06* (2013.01); *F41C 23/04* (2013.01); *F41C 23/06* (2013.01); *F41C 23/08* (2013.01); *F41C 23/20* (2013.01)

(58) Field of Classification Search

CPC .. F41A 3/84; F41A 25/10; F41A 25/14; F41C 23/06; F41C 23/12; F41C 23/14

USPC ..... 42/72–73

See application file for complete search history.

(56) References Cited

U.S. PATENT DOCUMENTS

| | | | | |
|---|---|---|---|---|
| 2,509,552 | A | 5/1950 | Wolf | |
| 7,793,453 | B1 * | 9/2010 | Sewell, Jr. | F41C 23/14 42/73 |
| 7,930,849 | B2 | 4/2011 | Abraham | |
| 8,720,099 | B1 | 5/2014 | Sisk | |
| 9,395,149 | B2 | 7/2016 | Balgaard | |
| 9,410,763 | B2 * | 8/2016 | Colt | F41C 23/04 |
| 9,562,740 | B1 | 2/2017 | Korliker | |
| 2005/0268516 | A1 | 12/2005 | Nelson | |
| 2007/0214697 | A1 | 9/2007 | Ochoa | |
| 2008/0028662 | A1 | 2/2008 | Abraham | |
| 2012/0137562 | A1 * | 6/2012 | Langevin | F41C 23/14 42/75.03 |
| 2014/0109453 | A1 | 4/2014 | Paquette | |
| 2016/0061559 | A1 | 3/2016 | Wood | |
| 2017/0160049 | A1 * | 6/2017 | Swineheart | F41C 23/14 |

* cited by examiner

*Primary Examiner* — Stephen Johnson
*Assistant Examiner* — Benjamin S Gomberg
(74) *Attorney, Agent, or Firm* — Michael A. Blake

(57) ABSTRACT

A shoulder fired weapon comprising: a lower receiver, a magazine removably attachable to the lower receiver; a buffer tube attached to the lower receiver; a buttstock attached to the buffer tube, and where the buttstock can rotate with respect to the lower receiver and the buttstock can lock into place. A rotating buffer apparatus comprising: a front end buffer tube, the front end buffer configured to screw into a lower receiver of a shoulder fired weapon; a rear end buffer tube, aligned with and adjacent to the front end buffer tube; the rear end buffer tube configured to attach to a buttstock; and where when the rotating buffer apparatus is installed into the shoulder fired weapon, the buttstock can rotate with respect to the lower receiver and the buttstock can lock into place.

30 Claims, 12 Drawing Sheets

ROTATING BUFFER APPARATUS

CROSS-REFERENCES

This patent application claims priority to provisional patent application No. 62/546,086 filed on Aug. 16, 2017, by Jeffrey T. Blake, and titled: "ROTATING BUFFER APPARATUS", which provisional application is fully incorporated by reference herein.

TECHNICAL FIELD

This invention relates to shoulder-fired weapons, and in particular to an improvement which allows the user to rotate the butt stock of a shoulder-fired weapon relative to the barrel and magazine portion of the weapon.

BACKGROUND

With the use of high capacity magazines or in difficult shooting situations with weapons such as, but not limited to M16, AR15, (.223/.556 caliber) and SR25, and AR 10 (.308/7.62 caliber) type rifles/carbine platforms, and any other rifle that utilizes a buffer tube as a component of the rifle assembly, it becomes difficult to shoot from a prone position (for example shooting from under an automobile) or with the use of short barrel rifles (SBRs) in tactical situations such as close quarters combat where it may be necessary to fire the weapon with the magazine horizontal rather than vertical. When the weapon is rotated 90° so the magazine is in the horizontal position the butt stock—located at the end of the buffer tube also rotates to the horizontal position, and thus the butt stock cannot be used to securely rest the butt stock against the user's shoulder.

Currently the misalignment of the butt stock to the cup of the shoulder is tolerated for situations as described above because there is no means for allowing the rifle to rotate while maintaining the vertical alignment of the butt stock to the shooter's shoulder.

Thus there is a need for a rotating buffer apparatus that overcomes the above listed and other disadvantages.

SUMMARY OF THE INVENTION

The disclosed invention relates to a shoulder fired weapon comprising: a lower receiver, a magazine removably attachable to the lower receiver; a buffer tube attached to the lower receiver; a buttstock attached to the buffer tube, and where the buttstock can rotate with respect to the lower receiver and the buttstock can lock into place.

The disclosed invention also relates to a rotating buffer apparatus comprising: a front end buffer tube, the front end buffer configured to screw into a lower receiver of a shoulder fired weapon; a rear end buffer tube, aligned with and adjacent to the front end buffer tube; the rear end buffer tube configured to attach to a buttstock; and where when the rotating buffer apparatus is installed into the shoulder fired weapon, the buttstock can rotate with respect to the lower receiver and the buttstock can lock into place.

BRIEF DESCRIPTION OF THE DRAWINGS

The present disclosure will be better understood by those skilled in the pertinent art by referencing the accompanying drawings, where like elements are numbered alike in the several figures, in which:

FIG. 20 is a perspective view of the detent pin, cam and member;

DETAILED DESCRIPTION OF THE INVENTION

Figure 1:
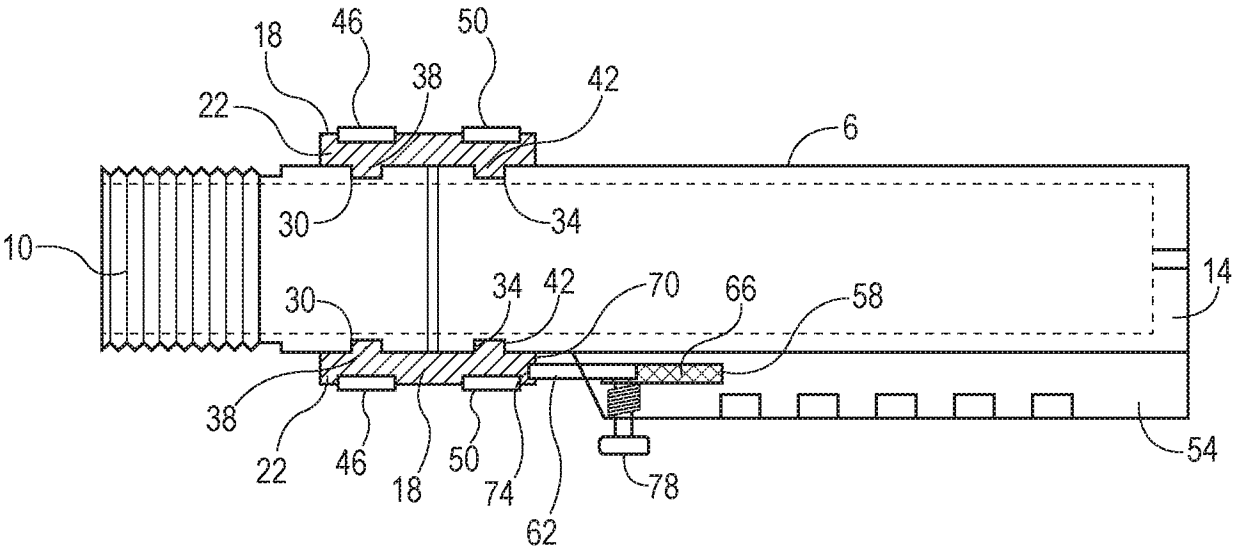
FIG. 1 is cross-sectional side view of a buffer tube.

FIG. 1 is a cross-sectional side view of a modified buffer tube 6 of a rifle. The buffer tube has been separated into a front end buffer tube 10 and a rear end buffer tube 14. The front end buffer tube 10 and rear end buffer tube 14 are attached to each other via an attachment means 18. The attachment means may be a pair of split sleeves 22, 26 (26 is not visible in this view) that attach to the front end buffer tube 10 and rear end buffer tube 14 via mating grooves 30, 34 on the buffer tubes 10, 14, and groove members 38, 42 on the inner surface of the split sleeves 22, 26. Retaining clamps 46, 50 are used to hold the split sleeves 22, 26 onto the buffer tubes 10, 14. Attached to the rear end buffer tube 14 is a detent housing 54. Located in the detent housing 54 is a detent cavity 58. A detent pin 62 and spring 66 are located in the detent cavity, with the spring 66 configured to exert a force on the detent pin 62 in the direction of the front end buffer tube 10. Located on a side 70 of the split sleeve 22 (the side generally orthogonal to the outer surface of the rear end buffer tube 14) is a first detent depression 74, configured to hold the detent pin 62 in place. The side 70 may be an orthogonal side that is perpendicular to the axis of the buffer tube 6 and faces the detent housing 54. The detent housing 54 may have a lockout pin 78. This lockout pin 78, when engaged, prevents the detent pin from leaving the first detent depression 74 (or other detent depression), and thereby preventing the rear end buffer tube 14 from rotating with respect to the front end buffer tube 10.

Figure 2:
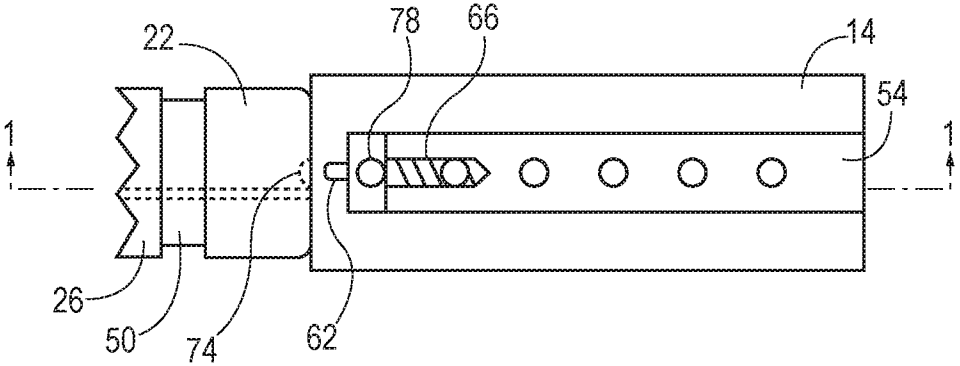
FIG. 2 is a bottom view of a split sleeve and rear end buffer tube.

FIG. 2 is a bottom view of the split sleeve 22 and rear end buffer tube 14. The first detent depression 74 is shown in dashed lines, because it would not otherwise be visible in this view.

Figure 3:
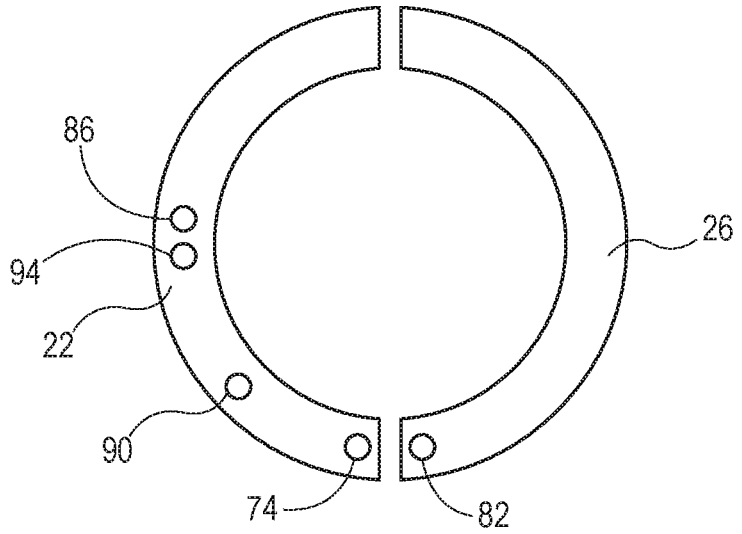
FIG. 3 is a rear view of a pair of split sleeves.
Figure 4:
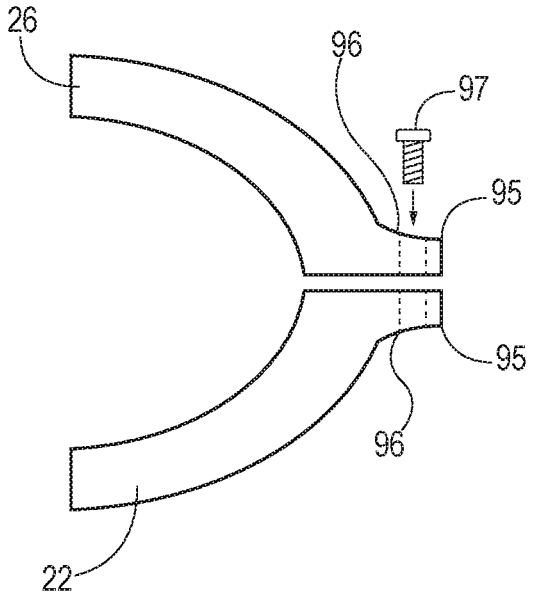
FIG. 4 is a side view of one embodiment of split sleeves.

FIG. 3 is a rear view of the pair of split sleeves 22, 26. Split sleeve 26 may have a stop pin 82, and split sleeve 22 may have a stop pin 86. The stop pins prevent over rotation of the rear end buffer tube 14. Split sleeve 26 has in addition to the first detent depression 74, a second detent depression 90, and a third detent depression 94. The second detent depression may be a "transitional" location, so that a user can rotate the rear end buffer tube 14 about 45°. The third detent depression 94 allows the user to rotation the rear end buffer tube 14 about 90° with respect to the first detent depression 74. The spherical detents 74, 90, and 94 may be located on both sides of the sleeve allowing for ambidextrous use of the invention (left-handed or right-handed). In another embodiment the spherical detents 74, 90, and 94 may be located at about every 10 degrees along the sleeve for even more variation FIG. 4 is a side view of one embodiment of the split sleeves 22, 26. In this embodiment, the split sleeves may have flanges 95, and threaded holes 96, and a screw 97 to attach the two split sleeves 22, 26 to the buffer tube 6. In the embodiment shown in FIG. 4, the split lines are horizontal. In other embodiments, the split line may be vertical.

Figure 5:
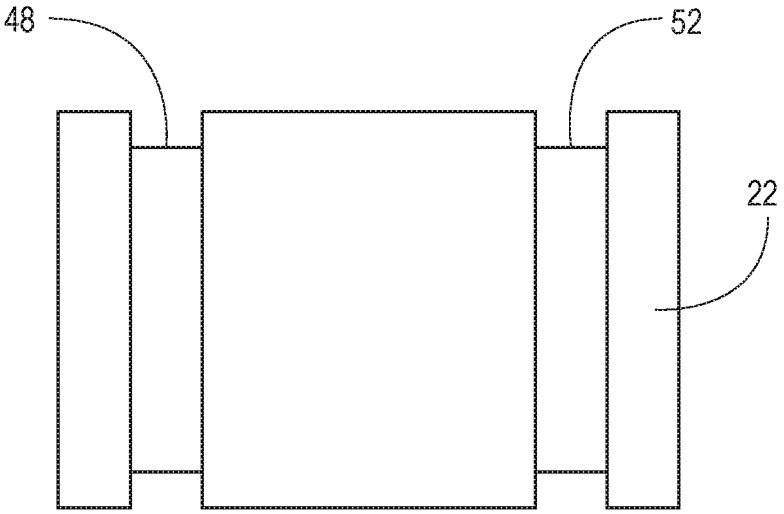
FIG. 5 is a front view of a split sleeve.

FIG. 5 is a front view of a split sleeve 22. In this view, the clamp grooves 48, 52 are shown. The clamp grooves 48, 52 are where the retaining clamps 46, 50 attach to the split sleeves 22, 26.

Figure 6:
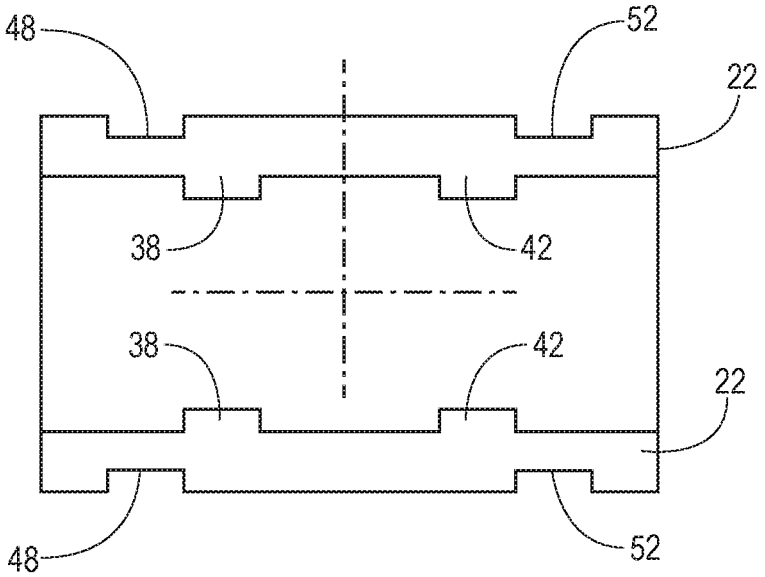
FIG. 6 is a cross-sectional view of the split sleeves from FIG. 5.

FIG. 6 is a cross-sectional view of the split sleeves 22 from FIG. 5.

Figure 7:
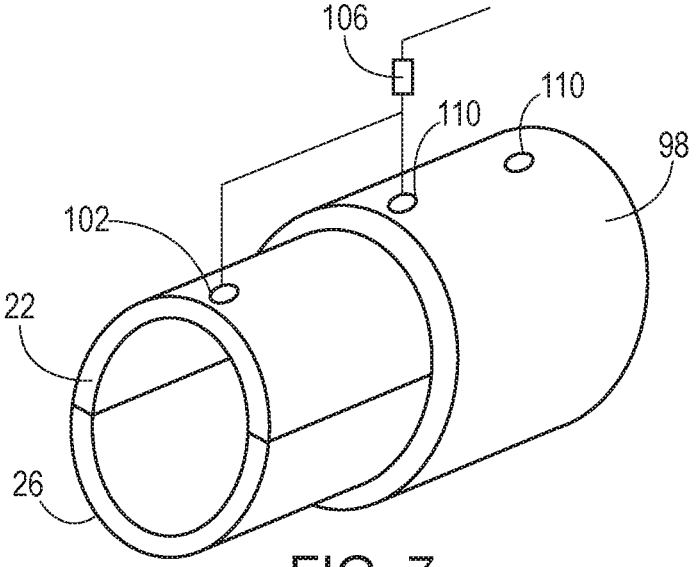
FIG. 7 is a perspective view of another embodiment of the split sleeves.

FIG. 7 shows another embodiment of how to attach the split sleeves 22, 26 to the buffer tube 6. In this embodiment, an outer sleeve 98 is press fit over the split sleeves 22, 26. Split sleeve 22 may have an indentation 102 configured to receive a set screw 106, that is screwed through a threaded hole 110 in the outer sleeve 98. There may be additional indentations 102 on split sleeves 22, 26, as well as additional threaded holes 110 in the outer sleeve, and additional set screws 106.

Figure 8:
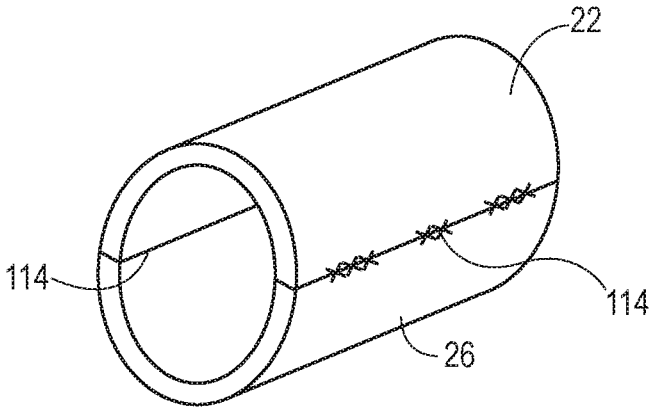
FIG. 8 is a perspective view of another embodiment of the split sleeves.

FIG. 8 shows another embodiment of how to attach the split sleeves 22, 26 to the buffer tube 6. In this embodiment, split sleeve 22 and split sleeve 26 are enclosed on a buffer tube 6, then the split sleeve 22 is welded to split sleeve 26 at a weld line 114. The split sleeves 22, 26 may be made out of a non-ferrous (aluminum or titanium) material or a ferrous (steel) material that is suitable for welding. In another embodiment, the split sleeves 22, 26 may be molded from an engineered resin (plastic) and the mode of assembly could be ultrasonic welding of the two halves of the attachment means 18.

Figure 9:
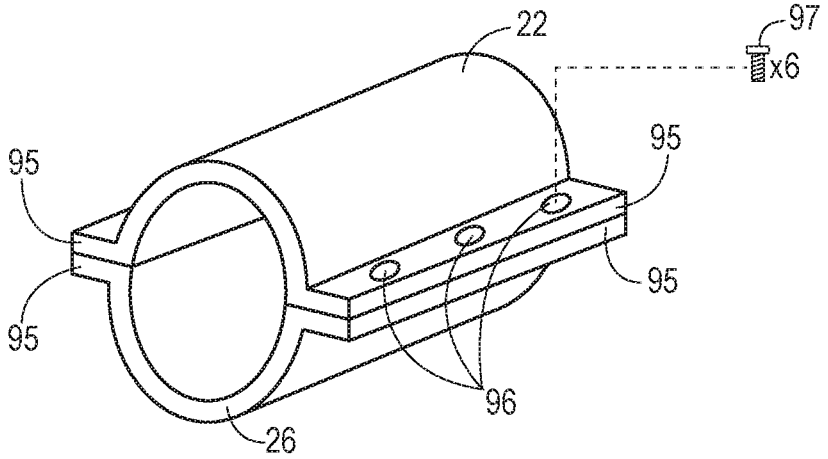
FIG. 9 is perspective view of another embodiment of the split sleeves.

FIG. 9 shows another embodiment of how to attach the split sleeves 22, 26 to the buffer tube 6. Similar to FIG. 4, split sleeve 22 and 26 have flanges 95, with threaded holes 96 through flanges 95 in sleeves 22, 26. In this embodiment, there may be six sets of threaded holes 96, three on each mating pair of flanges 95, and six screws 97 to attach the flanges 95 to each other and hold the split sleeves 22, 26 to the buffer tube 6.

Figure 10:
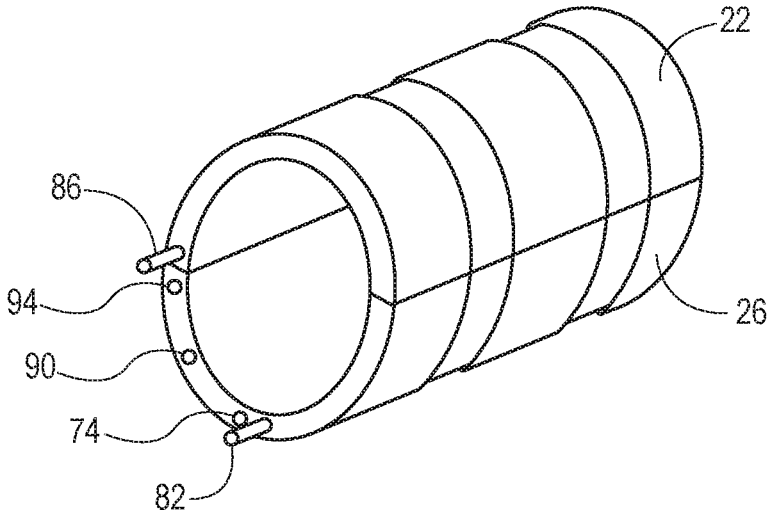
FIG. 10 is a perspective view of another embodiment of the split sleeves.

FIG. 10 is a perspective view of one embodiment of the split sleeves 22, 26. In this embodiment there is stop pin 86 on split sleeve 22, and a stop pin 82 on split sleeve 26. If the stop pin rotates into the detent pin 62, the user cannot rotate the buttstock 130 and rear end buffer tube 14 any further.

Figure 11:
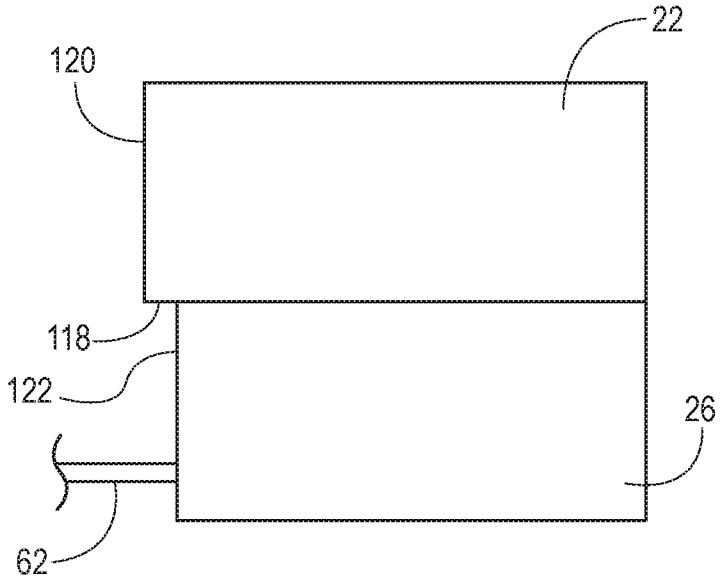
FIG. 11 is a side view of another embodiment of the split sleeves.

FIG. 11 is a side view of another embodiment of the split sleeves 22, 26. Split sleeve 22 has an end surface 120, and split sleeve 26 has an end surface 122. In this embodiment there are no stop pins, but rather, surface 122 is undercut with respect to surface 120. In other words split sleeve 22 extends further than split sleeve 26. Thus when orthogonal surface 118 abuts the detent pin 62, the user cannot rotate the buttstock 130 and rear end buffer tube 14 any further. Surface 118 act as stop pins 86 from FIG. 10. The orthogonal surface 18 is generally parallel to the axis of the split sleeves, and is orthogonal to end surface 120.

Figure 12:
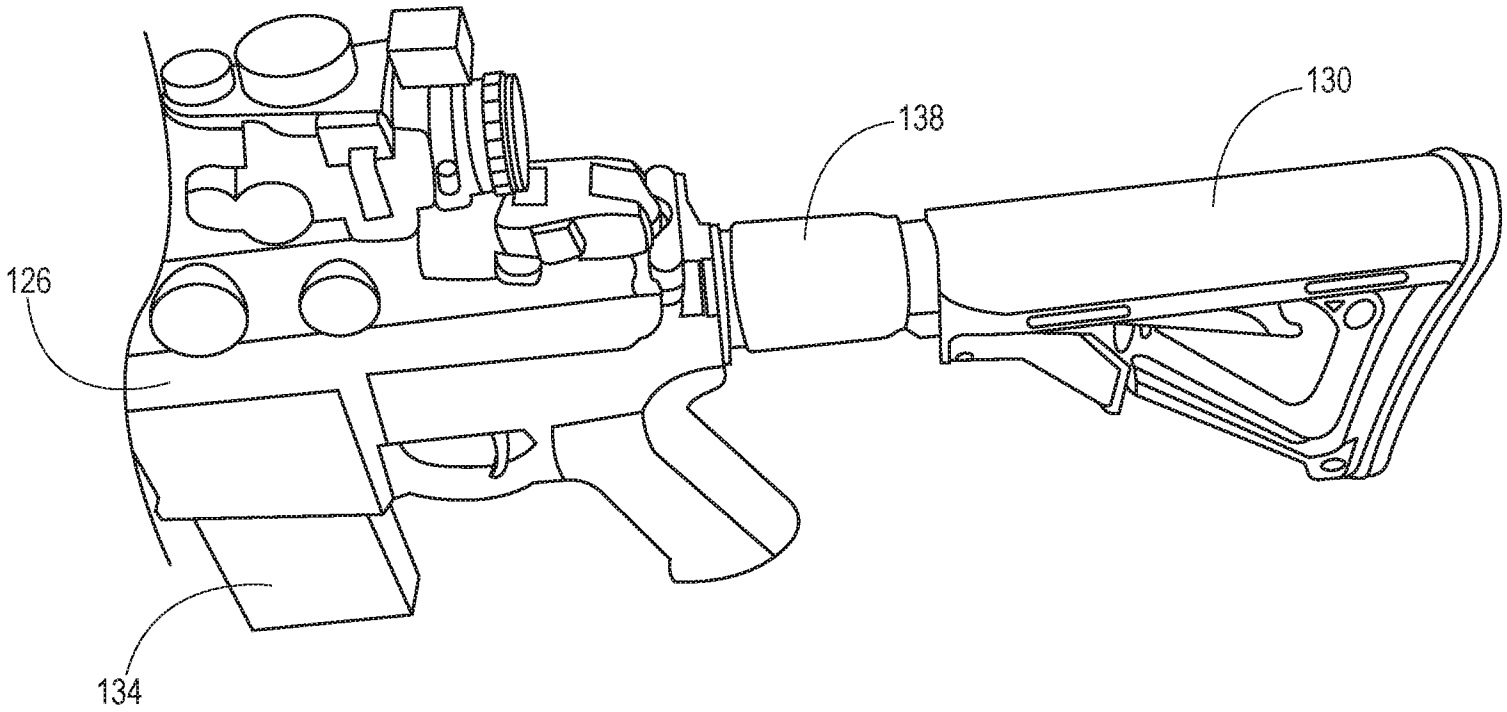
FIG. 12 is a perspective view of the invention installed on a rifle.

FIG. 12 shows the invention installed on a rifle 126. In this orientation, the butt-stock 130 is in line with the magazine 134. The split sleeves 22, 26 are under the cushioned sleeve 138.

Figure 13:
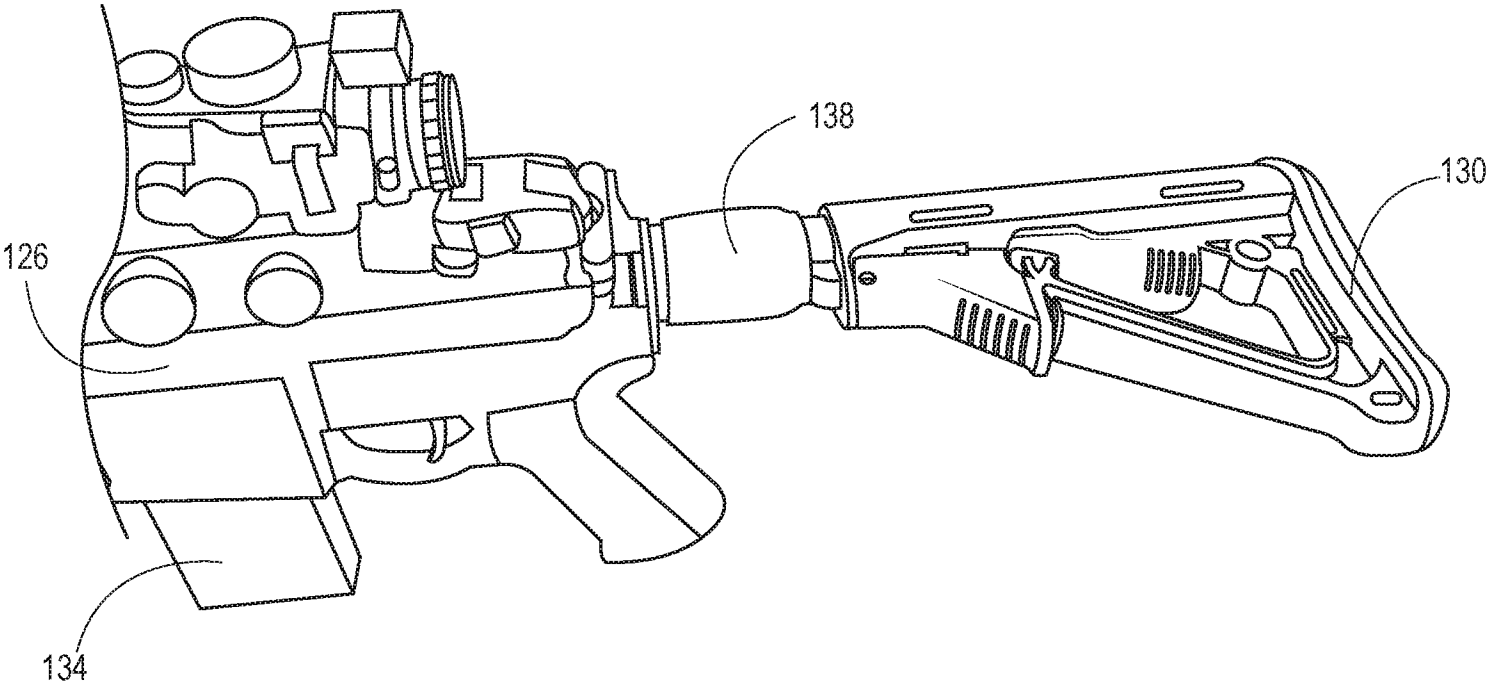
FIG. 13 is the invention from FIG. 12, showing the butt-stock rotated about 90° relative to the magazine.

FIG. 13 shows the butt-stock 130 rotated 90° relative to the magazine 134. This may be called the horizontal position.

Figure 14:
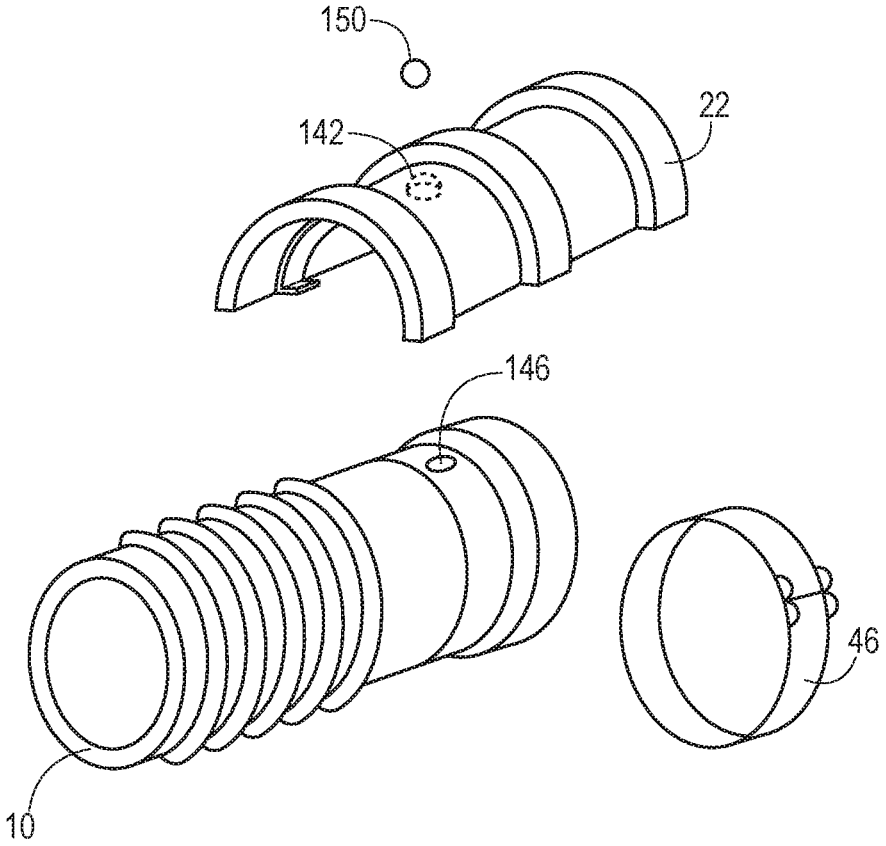
FIG. 14 is a perspective view showing an embodiment of the split sleeve and front end buffer tube.

FIG. 14 shows an embodiment of the split sleeve 22 and front end buffer tube 10 where the split sleeves 22, 26 do not rotate with respect to the front end buffer tube 10. In one embodiment, the split sleeve 22 has a detent cavity 142 on its inner surface. The front end buffer tube 10 has a matching detent cavity 146 on its outer surface. A detent key 150 is placed between the split sleeve 22 and front end buffer tube 10 so that is located within both detent cavities 142, 146. Thus when the retaining clamp 46 attaches the splits sleeves 22, 26 to the buffer tubes 10, 14, the detent key 50, and detent cavities 142, 146 will assist in preventing the split sleeves 22, 26 from rotating with respect to the front end buffer tube 10. In one embodiment, the detent key 50 will have a spherical shape, and the detent cavities 142, 146 will have a hemispherical shape. In another embodiment, the detent key 150 will have a rectangular prism shape, and the detent cavities 142, 146 will have a rectangular prism shape configured to accept the detent key 50.

Figure 15:
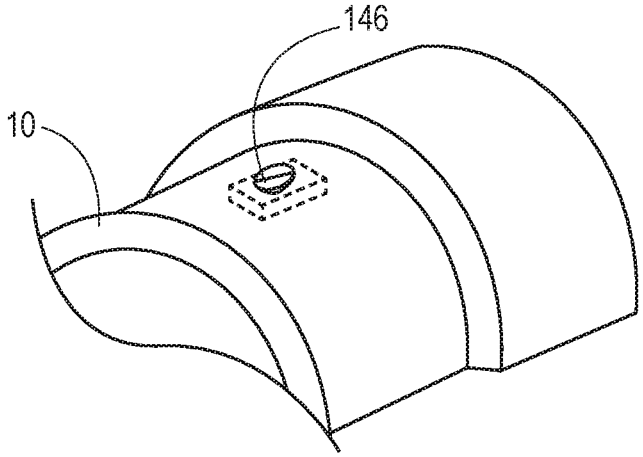
FIG. 15 is a close up view of the front end buffer tube.

FIG. 15 is a close up view of the front end buffer tube 10, and the detent cavity 146. In one embodiment the detent cavity 146 may have a hemispherical shape as shown. In another embodiment, the detent cavity 146 may have a rectangular prism shape, as shown by the dashed lines.

Figure 16:
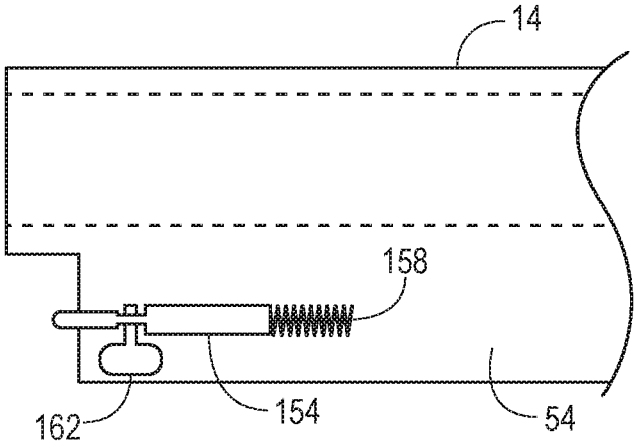
FIG. 16 is a cross-sectional view through a rear end buffer tube.
Figure 17:
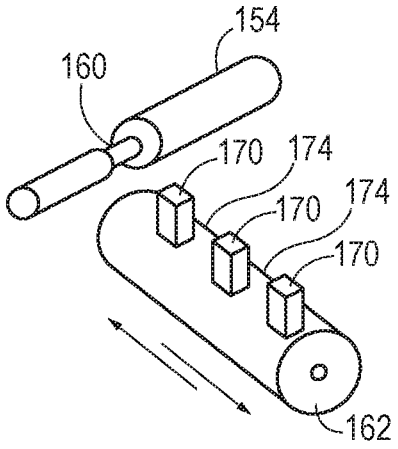
FIG. 17 is a perspective view of the detent pin and locking mechanism.
Figure 18:
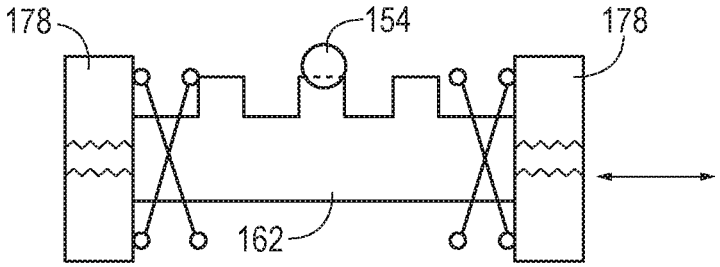
FIG. 18 is a front view of the locking mechanism with the detent pin.

FIG. 16 is a cross-sectional view through a rear end buffer tube 14 and shows an embodiment to lock the detent pin 154 in place to prevent the rear end buffer tube 14 and butt-stock 130 from rotating until the user releases the detent pin 154. In this embodiment, the detent pin 154 is spring loaded with a spring 158. A locking mechanism 162 engages with the detent pin 154. In one orientation, the locking mechanism 162 locks the detent pin 154 in place, and prevents the user from rotating the rear end buffer tube 14 and butt-stock 130. In another orientation, the locking mechanism 162 allows the detent pin 154 to move freely, and thus allows the user to rotate the rear end buffer tube 14 and butt-stock 130. FIG. 17 is a perspective view of the detent pin 154 and locking mechanism 162 and shows how the locking mechanism 162 engages with the detent pin 154. The detent pin 154 has an undercut 160. The undercut 160 is configured to slide over the two or more teeth 170 extending up from the locking mechanism 162. FIG. 18 is a front view of the locking mechanism 162 with the detent pin 154 in a locking orientation with respect to the locking mechanism 162. In a locking orientation, the undercut is located so that one of teeth 170 is within the undercut 160, such that the tooth 70 prevents the pin 154 from moving axially (along the axis of the detent pin 154), as shown in FIG. 18. In a released orientation, the pin 154 is located in a gap 174 between two of the teeth 170, so that the pin 154 is free to move axially with respect to the locking mechanism. The user controls the location of the locking mechanism 162 by pushing a cap 178 located on the end of the locking mechanism 162 in an axial direction (along the axis of the locking mechanism).

Figure 19:
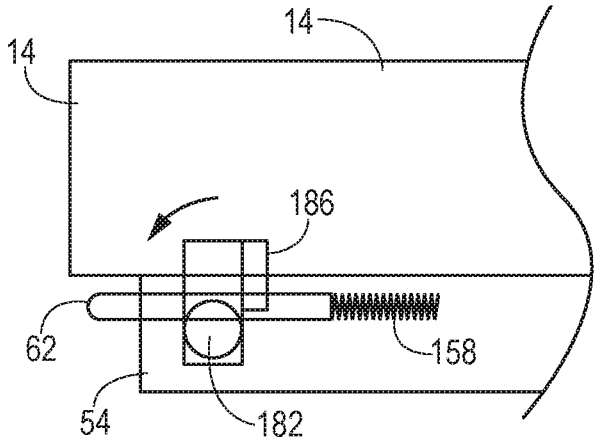
FIG. 19 is a cross-sectional view through a rear end buffer tube.
Figure 20:
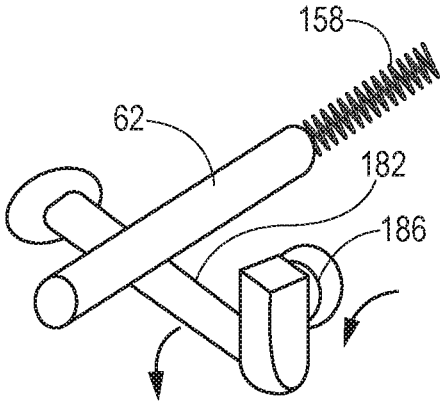
FIG. 20 is a perspective view of the invention from FIG. 19.

FIG. 19 is a cross-sectional view through a rear end buffer tube 14 and shows an embodiment to lock the detent pin 62 in place to prevent the rear end buffer tube 14 and butt-stock 130 from rotating until the user releases the detent pin 62. In this embodiment, a cam 182 is adjacent to the detent pin 62. The cam 182 can be rotated with respect to the detent pin 62 by the user rotating the member 186 which is attached to the cam 182. In a locking orientation, the cam 182 is rotated so that it is abutting the detent pin 62 thereby preventing the detent pin from moving axially, and thus preventing the rear end buffer tube 14 and butt-stock 130 from rotating until the user releases the detent pin 62. In a released orientation, the cam 182 is rotated so that it no longer abuts the detent pin, and the detent pin 62 can move freely axially, and the rear end buffer tube 14 and butt-stock 130 can be rotated. FIG. 20 is a perspective view of the detent pin 62, cam 182 and member 186.

Figure 21:
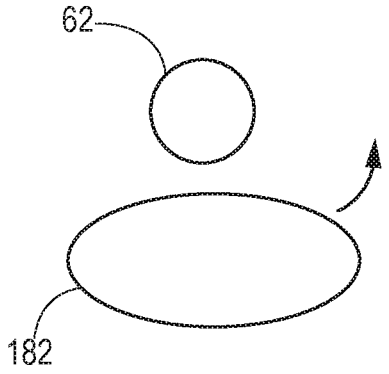
FIG. 21 is a side view of the cam and pin.
Figure 22:
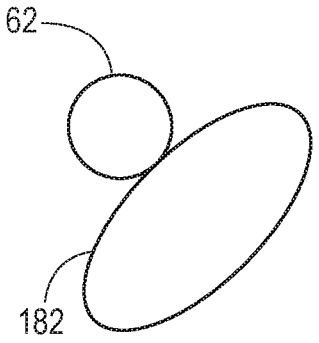
FIG. 22 is a side view of the cam and pin from FIG. 21 rotated into a locking orientation.

FIG. 21 shows the cam 182 and pin 62 in a released orientation, such that the cam 182 is not abutting the pin 62, and the pin 62 is free to move axially. FIG. 22 shows the cam 182 and pin 62 in a locking orientation, such that the cam 182 has been rotated so that it is abutting the pin 62, and the pin 62 is prevented from moving axially and thus the rear end buffer tube 14 and butt-stock 130 cannot be rotated.

The rotating buffer apparatus allows for the rotation of the rifle to the horizontal position while maintaining the vertical alignment of the butt stock to the shooters shoulder. The rotating buffer apparatus also maintains the concentricity of the two halves of the buffer tube as there is a spring and buffer that reciprocate through the inner diameter of the buffer tube. This concentricity is critical to the operation of the rifle.

This invention has many advantages. It allows one to rotate the magazine portion of a rifle relative to the butt-stock, thus allowing the butt stock to rest comfortably against the shoulder, in tight spaces, such as when shooting from underneath an automobile. The invention gives the ability to cant the rifle to an about 45° position. The invention allows for ease of use with auxiliary targeting systems such as 45 Degree Offset Rapid Transition Backup Iron Sights (BUIS), Ruggedized Miniature Reflex (RMR), or Red Dot Sight when used in conjunction with the primary targeting features used at the 12:00 o'clock position on the rifle. The invention allows the stock to remain in the cup of the arm and shoulder while the rifle is moved to an about 45° position.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A shoulder fired weapon comprising:
- a lower receiver;
- a magazine removably attachable to the lower receiver;
- a buffer tube attached to the lower receiver, wherein the buffer tube comprises:
  - a front end buffer tube, the front end buffer configured to screw into the lower receiver;
  - a rear end buffer tube, aligned with and adjacent to the front end buffer tube;
  - a first split sleeve configured to slide over the front end buffer tube and the rear end buffer tube where the front end buffer tube and the rear end buffer tube are adjacent to each other; and
  - a second split sleeve configured to slide over the front end buffer tube and the rear end buffer tube where the front end buffer tube and the rear end buffer tube are adjacent to each other, and on a side opposite from the first split sleeve, and the second split sleeve is configured to attach to the first split sleeve; and wherein the rear end buffer tube is rotatable with respect to the front end buffer tube while the front end buffer tube and the rear end buffer tube are each positioned within the first and second split sleeves;
- a buttstock attached to the buffer tube, and wherein the buttstock can rotate with respect to the lower receiver and the buttstock can lock into place.

2. The shoulder fired weapon of claim 1, further comprising:
- at least one detent depression located on an orthogonal end surface of at least one of the split sleeves, the orthogonal end surface generally perpendicular to an axis of the front end buffer tube and the rear end buffer tube;
- a detent housing located on the rear end buffer tube;
- a spring loaded detent pin located in the detent housing and configured to abut the at least one detent depression;
- wherein when the detent pin is abutting the at least one detent depression, the rotation of the rear end buffer tube with respect to the front end buffer is limited by the force of the detent pin pushing against the detent depression.

3. The shoulder fired weapon of claim 2, further comprising:
- a set screw located in the detent housing, and configured to screw into and abut the detent pin, such that the detent pin cannot back out of the detent depression until released by the set screw.

4. The rotating buffer apparatus of claim 2, further comprising:
- a stop pin extending from the orthogonal end surface of the first split sleeve or the second split sleeve, the stop pin configured to stop rotation of the rear end buffer tube with respect to the front end buffer tube when the stop pin abuts against the detent pin.

5. The shoulder fired weapon of claim 2, further comprising:
- an undercut on the orthogonal end surface of the first split sleeve or the second split sleeve, such that the split sleeve that does not have the undercut will have an orthogonal end surface that extends beyond the orthogonal end surface of the split sleeve with the undercut, and that the orthogonal end surface that extends beyond the orthogonal end surface of the split sleeve with the undercut will stop the rotation of the rear end buffer tube when the portion that extends abuts the detent pin.

6. The shoulder fired weapon of claim 3, further comprising:

a split sleeve detent cavity on an inner surface of the first split sleeve or the second split sleeve;

a buffer tube detent cavity on an outer surface of the front end buffer tube;

a key configured to sit in both the split sleeve detent cavity and buffer tube detent cavity, the key and the detent cavities preventing the split sleeves from rotating with respect to the front end buffer tube.

7. The shoulder fired weapon of claim 6, wherein the split sleeve detent cavity has a hemispherical shape, the buffer tube detent cavity has a hemispherical shape, and the key has a spherical shape.

8. The shoulder fired weapon of claim 6, wherein the split sleeve detent cavity has a rectangular prism shape, the buffer tube detent cavity has a rectangular prism shape, and the key has a rectangular prism shape.

9. The shoulder fired weapon of claim 2, further comprising:

an undercut on the detent pin;

a locking mechanism in slideable communication with the detent housing, the locking mechanism comprising:

a horizontal member;

two teeth extending upward from the horizontal member;

a gap located between the two teeth;

the horizontal member oriented perpendicularly to the detent pin;

wherein when the locking mechanism is slid so that the detent pin is located in the gap, the detent pin is in an unlocked position, and the rear end buffer tube can rotate with respect to the front end buffer tube; and when the locking mechanism is slid so that one of the teeth is located in the undercut, the detent pin cannot move axially, and the detent pin is in a locked position and the rear end buffer tube cannot rotate with respect to the front end buffer tube.

10. The shoulder fired weapon of claim 2, further comprising:

a cam located in the detent housing and configured to abut against the detent pin when rotated into a locked position, when in a locked position, the cam abutting the detent pin prevents the detent pin from moving axially and the rear end buffer tube cannot rotate with respect to the front end buffer tube, the cam further configured to not abut the detent pin when rotated into an unlocked position, when in an unlocked position, the cam does not abut the detent pin, and the detent pin is free to move axially and the rear end buffer tube can rotate with respect to the front end buffer tube; and a rotatable member extending from the detent housing and attached to the cam, wherein the rotatable member can be rotated to put the cam into a locked position or into an unlocked position.

11. The shoulder fired weapon of claim 1, further comprising:

a first circumferential groove located on an outer surface of the front end buffer tube;

a second circumferential groove located on an outer surface of the rear end buffer tube;

a first circumferential raised band located on the inner surface of the first split sleeve and the second split sleeve, the first circumferential raised band configured to mate with the first circumferential groove;

a second circumferential raised band located on the inner surface of the first split sleeve and the second split sleeve, the second circumferential raised band configured to mate with the second circumferential groove;

wherein when the first and second circumferential bands mate with the first and second circumferential grooves, the splits sleeves prevent the front end buffer tube from moving axially with respect to the rear end buffer tube, while still allowing the front end buffer tube to rotate relative to the rear end buffer tube.

12. The shoulder fired weapon of claim 1, further comprising:

a cylindrical sleeve press fit onto the first and second split sleeve.

13. The shoulder fired weapon of claim 12, further comprising:

a set screw hole in the cylindrical sleeve;

a set screw configured to screw into the set screw hole and abut one of the first and the second split sleeve.

14. The shoulder fired weapon of claim 1, wherein the first split sleeve is welded to the second split sleeve.

15. The shoulder fired weapon of claim 2, further comprising:

a first split sleeve flange located along one edge of the first split sleeve, the first split sleeve flange extending orthogonally out from the first split sleeve, the first split sleeve flange having a plurality of threaded holes arranged on the first split sleeve flange along a line that is parallel to an axis of the first split sleeve;

a second split sleeve flange located along an opposite edge of the first split sleeve, the second split sleeve flange extending orthogonally out from the split sleeve, the second split sleeve flange having a plurality of threaded holes arranged on the second split sleeve flange along a line that is parallel to the axis of the first split sleeve;

a third split sleeve flange located along one edge of the second split sleeve, the third split sleeve flange extending orthogonally out from the second split sleeve, the third split sleeve flange having a plurality of threaded holes arranged on the third split sleeve flange along a line that is parallel to an axis of the second split sleeve; and a fourth split sleeve flange located along an opposite edge of the second split sleeve, the fourth split sleeve flange extending orthogonally out from the second split sleeve, the fourth split sleeve flange having a plurality of threaded holes arranged on the fourth split sleeve flange along a line that is parallel to the axis of the second split sleeve;

wherein the first split sleeve is attachable to the second split sleeve via screws configured to screw into the threaded holes of the flanges.

16. A rotating buffer apparatus comprising:

a front end buffer tube, the front end buffer tube configured to screw into a lower receiver of a shoulder fired weapon;

a rear end buffer tube, aligned with and adjacent to the front end buffer tube; the rear end buffer tube configured to attach to a buttstock;

a first split sleeve configured to slide over the front end buffer tube and the rear end buffer tube where the front end buffer tube and the rear end buffer tube are adjacent to each other;

a second split sleeve configured to slide over the front end buffer tube and the rear end buffer tube where the front end buffer tube and the rear end buffer tube are adjacent to each other, and on a side opposite from the first split sleeve, and the second split sleeve is configured to attach to the first split sleeve; and wherein the rear end buffer tube is rotatable with respect to the front end buffer tube while the front end buffer tube and the rear end buffer tube are each positioned within the first and second split sleeves; and wherein when the rotating buffer apparatus is installed into the shoulder fired weapon, the buttstock can rotate with respect to the lower receiver and the buttstock can lock into place.

17. The rotating buffer apparatus of claim 16, further comprising:

at least one detent depression located on an orthogonal end surface of at least one of the split sleeves, the orthogonal end surface generally perpendicular to an axis of the front end buffer tube and the rear end buffer tube;

a detent housing located on the rear end buffer tube;

a spring loaded detent pin located in the detent housing and configured to abut the at least one detent depression;

wherein when the detent pin is abutting the at least one detent depression, the rotation of the rear end buffer tube with respect to the front end buffer is limited by the force of the detent pin pushing against the detent depression.

18. The rotating buffer apparatus of claim 17, further comprising:

a set screw located in the detent housing, and configured to screw into and abut the detent pin, such that the detent pin cannot back out of the detent depression until released by the set screw.

19. The rotating buffer apparatus of claim 17, further comprising:

a stop pin extending from the orthogonal end surface of the first split sleeve or the second split sleeve, the stop pin configured to stop rotation of the rear end buffer tube with respect to the front end buffer when the stop pin abuts against the detent pin.

20. The rotating buffer apparatus of claim 17, further comprising:

an undercut on the orthogonal end surface of the first split sleeve or the second split sleeve, such that the split sleeve that does not have the undercut will have an orthogonal end surface that extends beyond the orthogonal end surface of the split sleeve with the undercut, and that the orthogonal end surface that extends beyond the orthogonal end surface of the split sleeve with the undercut will stop the rotation of the rear end buffer tube when the portion that extends abuts the detent pin.

21. The rotating buffer apparatus of claim 17, further comprising:

a split sleeve detent cavity on an inner surface of the first split sleeve or the second split sleeve;

a buffer tube detent cavity on an outer surface of the front end buffer tube;

a key configured to sit in both the split sleeve detent cavity and buffer tube detent cavity, the key and the detent cavities preventing the split sleeves from rotating with respect to the front end buffer tube.

22. The rotating buffer apparatus of claim 21, wherein the split sleeve detent cavity has a hemispherical shape, the buffer tube detent cavity has a hemispherical shape, and the key has a spherical shape.

23. The rotating buffer apparatus of claim 21, wherein the split sleeve detent cavity has a rectangular prism shape, the buffer tube detent cavity has a rectangular prism shape, and the key has a rectangular prism shape.

24. The rotating buffer apparatus of claim 17, further comprising:

an undercut on the detent pin;

a locking mechanism in slideable communication with the detent housing, the locking mechanism comprising:

a horizontal member;

two teeth extending upward from the horizontal member;

a gap located between the two teeth;

the horizontal member oriented perpendicularly to the detent pin;

wherein when the locking mechanism is slid so that the detent pin is located in the gap, the detent pin is in an unlocked position, and the rear end buffer tube can rotate with respect to the front end buffer tube; and when the locking mechanism is slid so that one of the teeth is located in the undercut, the detent pin cannot move axially, and the detent pin is in a locked position and the rear end buffer tube cannot rotate with respect to the front end buffer tube.

25. The rotating buffer apparatus of claim 17, further comprising:

a cam located in the detent housing and configured to abut against the detent pin when rotated into a locked position, when in a locked position, the cam abutting the detent pin prevents the detent pin from moving axially and the rear end buffer tube cannot rotate with respect to the front end buffer tube, the cam further configured to not abut the detent pin when rotated into an unlocked position, when in an unlocked position, the cam does not abut the detent pin, and the detent pin is free to move axially and the rear end buffer tube can rotate with respect to the front end buffer tube; and a rotatable member extending from the detent housing and attached to the cam, wherein the rotatable member can be rotated to put the cam into a locked position or into an unlocked position.

26. The rotating buffer apparatus of claim 16, further comprising:

a first circumferential groove located on an outer surface of the front end buffer tube;

a second circumferential groove located on the outer surface of the rear end buffer tube;

a first circumferential raised band located on the inner surface of the first split sleeve and the second split sleeve, the first circumferential raised band configured to mate with the first circumferential groove;

a second circumferential raised band located on the inner surface of the first split sleeve and the second split sleeve, the second circumferential raised band configured to mate with the second circumferential groove;

wherein when the first and second circumferential bands mate with the first and second circumferential grooves, the splits sleeves prevent the front end buffer tube from moving axially with respect to the rear end buffer tube, while still allowing the front end buffer tube to rotate relative to the rear end buffer tube.

27. The rotating buffer apparatus of claim 16, further comprising:

a cylindrical sleeve press fit onto the first and second split sleeve.

28. The rotating buffer apparatus of claim 27, further comprising:

a set screw hole in the cylindrical sleeve;

a set screw configured to screw into the set screw hole and abut one of the first and the second split sleeve.

29. The rotating buffer apparatus of claim 16, wherein the first split sleeve is welded to the second split sleeve.

30. The shoulder fired weapon of claim 16, further comprising:

a first split sleeve flange located along one edge of the first split sleeve, the first split sleeve flange extending orthogonally out from the first split sleeve, the first split sleeve flange having a plurality of threaded holes arranged on the first split sleeve flange along a line that is parallel to an axis of the first split sleeve;

a second split sleeve flange located along an opposite edge of the first split sleeve, the second split sleeve flange extending orthogonally out from the first split sleeve, the second split sleeve flange having a plurality of threaded holes arranged on the second split sleeve flange along a line that is parallel to the axis of the first split sleeve;

a third split sleeve flange located along one edge of the second split sleeve, the third split sleeve flange extending orthogonally out from the second split sleeve, the third split sleeve flange having a plurality of threaded holes arranged on the third split sleeve flange along a line that is parallel to an axis of the second split sleeve; and a fourth split sleeve flange located along an opposite edge of the second split sleeve, the fourth split sleeve flange extending orthogonally out from the second split sleeve, the fourth split sleeve flange having a plurality of threaded holes arranged on the fourth split sleeve flange along a line that is parallel to the axis of the second split sleeve;

wherein the first split sleeve is attachable to the second split sleeve via screws configured to screw into the threaded holes of the flanges.

* * * * *